United States Patent [19]

Seiki et al.

[11] Patent Number: 4,543,776

[45] Date of Patent: Oct. 1, 1985

[54] METHOD FOR YARN PIECING IN FASCIATED YARN SPINNING UNIT

[75] Inventors: Kazuo Seiki, Kariya; Yoshihisa Suzuki, Chiryu; Yoshiharu Yasui, Toyota, all of Japan

[73] Assignee: Kabushiki Kaisha Toyoda Jidoshokki Seisakusho, Aichi, Japan

[21] Appl. No.: 534,555

[22] Filed: Sep. 22, 1983

[30] Foreign Application Priority Data

Sep. 28, 1982 [JP] Japan ..... 57-167476

[51] Int. Cl.[4] ..... D01H 15/00; D01H 15/02; D01H 5/28

[52] U.S. Cl. ..... 57/261; 57/328; 57/263

[58] Field of Search ..... 57/328, 261, 263, 22, 57/350

[56] References Cited

U.S. PATENT DOCUMENTS 3,992,865 11/1976 Tsuchida et al. ..... 57/328
4,114,358 9/1978 Tsuchida et al. ..... 57/328

FOREIGN PATENT DOCUMENTS 35033 4/1978 Japan ..... 57/261

*Primary Examiner*—John Petrakes
*Attorney, Agent, or Firm*—Burgess, Ryan & Wayne

[57] ABSTRACT

A novel method for yarn piecing in a fasciated yarn spinning unit, in which a broken end of a yarn and the fiber bundle to be pieced together are nipped and intermingled with each other between a soft nipping area between middle top and bottom aprons and thereafter are false-twisted by a vortex in an air nozzle. Motions of the associated parts are controlled as so to be able to achieve a suitable overlapping length of the yarn and the fiber bundle in the nipping area of the aprons.

4 Claims, 11 Drawing Figures

METHOD FOR YARN PIECING IN FASCIATED YARN SPINNING UNIT

BACKGROUND OF THE INVENTION

1. Field of the Invention

This invention relates to a method for yarn piecing in a fasciated yarn spinning unit.

2. Description of the Prior Art

Significant improvements have been made in fasciated yarn spinning recently, resulting in high processing speeds of as much as 150 m/min.

In fasciated yarn spinning, a fiber bundle is twisted by a vortex while passing through a channel of an air nozzle. In the structure of the yarn thus obtained, a plurality of surface fibers are entangled around a core portion having substantially no twist.

Due to the above-mentioned double structure of the yarn, however, there is a serious problem with yarn piecing. The tensile strength of the fasciated yarn mainly depends on the binding effect of the surface fibers around the core portion. Accordingly, it is impossible to piece a yarn merely by overlapping the broken end with the fiber bundle as is the case of ring spinning. The broken end of the yarn has to be intermingled with the fiber bundle and twisted together for ensuring complete piecing.

Japanese Unexamined Patent Publication No. 53-35033 discloses a yarn piecing method for a fasciated yarn spinning unit comprising the steps of introducing a broken end of a yarn reversely into an air nozzle for twisting a fiber bundle, nipping the end between a pair of front rollers of drafting means disposed adjacent to the air nozzle, starting the drafting means to advance a fiber bundle, and simultaneously applying compressed air to the air nozzle to generate a vortex therein, whereby the broken end of the yarn and the fiber bundle are pieced together during passage through the air nozzle.

In this prior art, however, the broken end and the fiber bundle cannot be fully intermingled, which causes failure of piecing or a weak and/or conspicuous joint in the resultant yarn.

SUMMARY OF THE INVENTION

Thus, it is an object of the present invention to provide a method for yarn piecing in fasciated yarn spinning which can eliminate the above drawbacks in the prior art.

It is another object of the present invention to provide a yarn piecing method for fasciated yarn spinning which can easily be carried out by an automatic yarn piecer.

The above-mentioned objects are achievable, in a fasciated yarn spinning unit comprising a drafting means having a front pair of top and bottom rollers, a middle pair of top and bottom aprons, and a back pair of top and bottom rollers; an air nozzle; and a yarn detecter, whereby a fiber bundle attenuated by the drafting means is false-twisted to be a yarn by a vortex generated in the air nozzle and is wound to form a package under watching for yarn breakage by the yarn detecter, by a method comprising the steps of: stopping rotation of the back bottom roller in accordance with a yarn breakage signal from the yarn detecter while allowing the middle and front pairs to continue to rotate; introducing the yarn rewound from the package into the air nozzle from an outlet thereof to an inlet thereof; nipping the yarn between the middle pair; restarting generation of the vortex; and restarting the back pair with such a time delay after the preceeding nipping step that a leading end of the fiber bundle can overlap with a trailing end of the yarn within a nipping zone of the middle pair.

Preferably, prior to the nipping step of the middle pair, the top roller and top apron of the front and middle pairs are separated from the bottom roller and bottom apron thereof, respectively, to form a gap therebetween, and the yarn is guided through the gap to extend outside of the drafting means.

Further, the yarn may be cut to have a predetermined trailing length to ensure a proper overlapping of the yarn and the fiber bundle.

BRIEF DESCRIPTION OF THE DRAWINGS

An embodiment of the present invention will now be described in detail in reference to the accompanying drawings, in which.

DESCRIPTION OF THE PREFERRED EMBODIMENT

Figure 1:
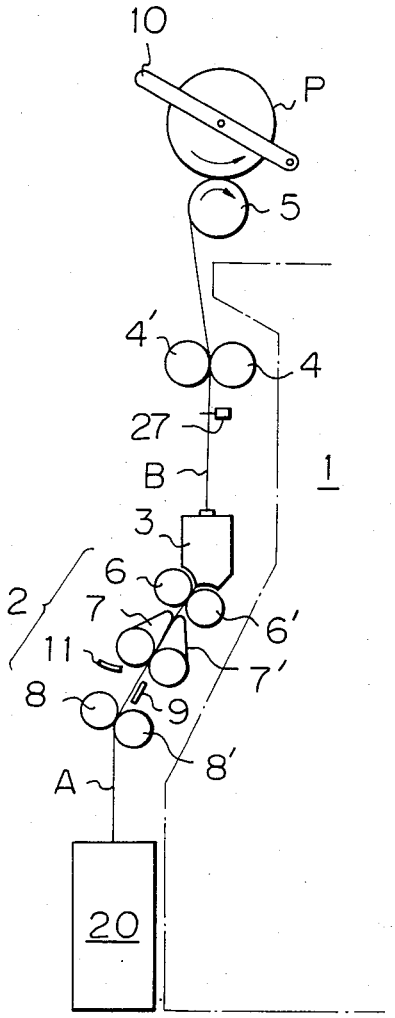
FIG. 1 is a schematic side view of a fasciated yarn spinning unit to which the present invention is applied.
Figure 2:
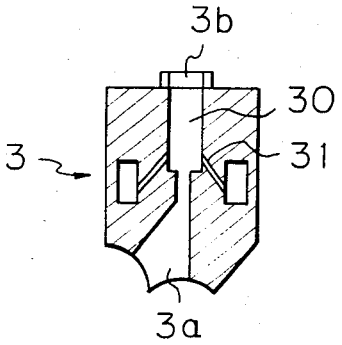
FIG. 2 is a sectional side view of an air nozzle of the fasciated yarn spinning unit.

A fasciated yarn spinning unit to which the present invention is applied is schematically illustrated in FIG. 1. The unit comprises a drafting means 2, an air nozzle 3, a pair of draw-off rollers 4, 4', a take-up roller 5, and an arm 10 for supporting a bobbin for a yarn package P, all of which are arranged on a machine frame 1. The drafting means 2 comprises three pairs of top and bottom elements, i.e., front rollers 6, 6', middle aprons 7, 7', and back rollers 8, 8'. As shown in FIG. 2, the air nozzle 3 has a channel 30 utilized for yarn passage and a plurality of jets 31 for ejecting compressed air within the channel 30 to generate a vortex.

A sliver A is fed from a can 20 on a floor to the drafting means 2 and is attenuated thereby to be a ribbon shaped fiber bundle of required thickness. The fiber bundle is then delivered from the front rollers 6, 6' into the air nozzle 3, in which it is twisted by the vortex and is transformed to a fasciated yarn B. The yarn B is continuously drawn out from the air nozzle by the draw-off rollers 4, 4' under the watch of a yarn detector 27 and then is wound on the bobbin to form the yarn package P by the action of the take-up roller 5 and the arm 10. For facilitating smooth running of the fiber bundle in the drafting means 2, a plate 9 may be provided between the back rollers 8, 8' and the middle aprons 7, 7'.

Figure 3:
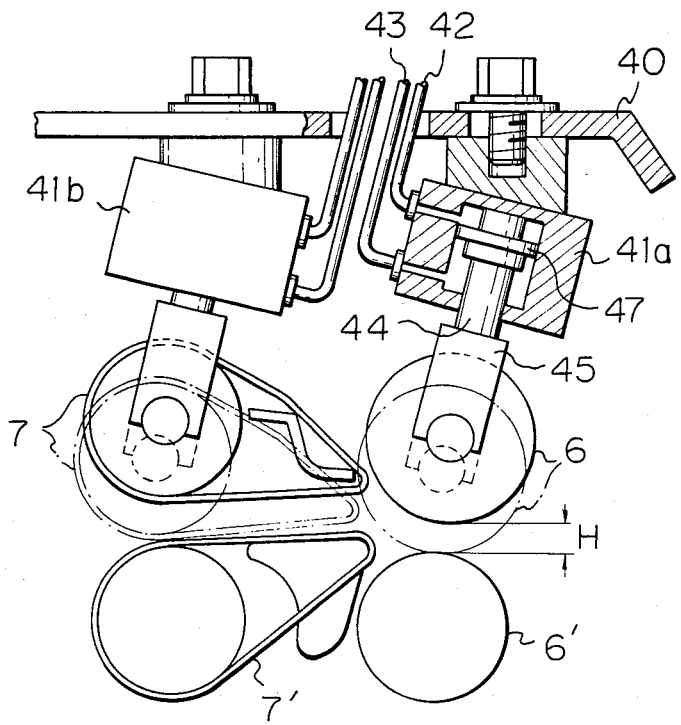
FIG. 3 is an enlarged sectional side view of a part of a drafting means mainly illustrating a means for individually pressing top side elements of the drafting means.

The drafting means 2 is devised in such a manner that the top side elements 6, 7, and 8 of the three pairs can individually be pressed onto or separated from the bottom side elements 6', 7', and 8' by means of air cylinders 41*a*, 41*b*,—secured on a back side surface of a weighting arm 40, as shown in FIG. 3. In FIG. 3, only the front pair 6, 6' and the middle pair 7, 7' of the drafting means 2 are illustrated for simplicity. The back pair 8, 8' may also be provided with a similar mechanism. The front top roller 6 is rotatably supported by a holder 45 secured to a piston rod 44 of the air cylinder 41*a*. The air cylinder 41*a* is provided with two air pipes 42 and 43 connected to a compressed air source through solenoid valves (not shown). When air is fed through the pipe 42 from the source, a piston 47 of the air cylinder 41 moves downward to press the top roller 6 onto the bottom roller 6', as shown by chain lines, so that nipping of the fiber bundle can be achieved.

On the other hand, when air is fed through the pipe 43, the piston 47 moves upward to form a gap H between the top and bottom rollers 6 and 6', as shown by solid lines. The same is true for the middle pair 7, 7' and the back pair 8, 8'.

Figure 4:
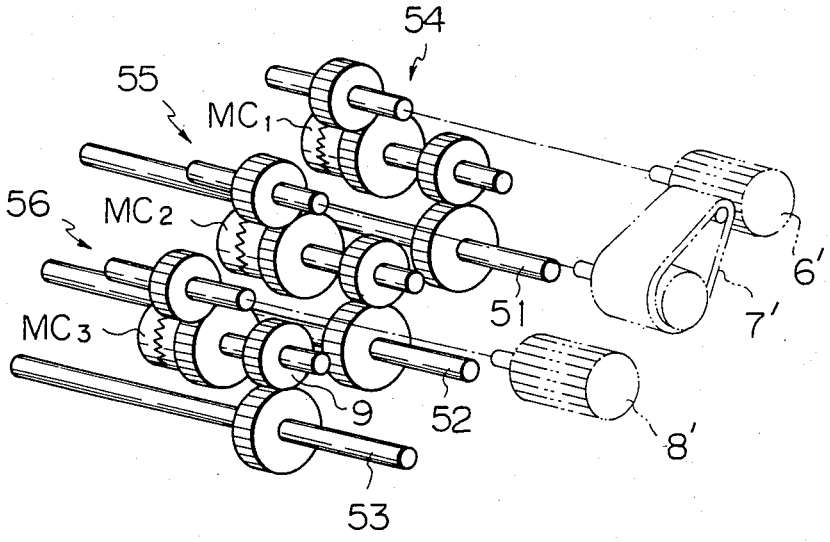
FIG. 4 is a perspective view of a driving mechanism for a drafting means.

As shown in FIG. 4, the bottom side elements 6', 7', and 8' are respectively connected to independent driving shafts 51, 52, and 53 through transmissions 54, 55, and 56. The transmissions 54, 55, and 56 include magnetic clutches $MC_1$, $MC_2$, and $MC_3$, respectively, to engage or disengage the bottom side elements 6', 7', and 8' to or from the driving shafts 51, 52, and 53.

Figure 8:
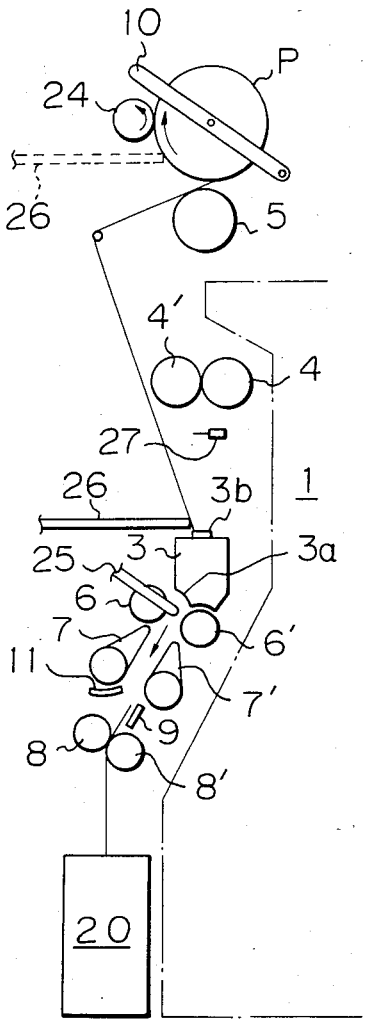
FIGS. 8, 9, and 11 are views similar to FIG. 5 showing steps of yarn piecing according to the present invention.

The yarn piecing operation is preferably carried out by an automatic yarn piecer traveling along a row of the spinning units on the frame. As partially illustrating in FIGS. 8, 9, and 10, the piecer comprises a rewinding roller 24 which holds the package P at a position apart from a surface of the take-up roller 5 and makes it rotate independently from the take-up roller 5 normally or reversely with various speeds during the piecing operation, a yarn catcher 26 for picking up a broken end of the yarn from the package surface and transporting it to an outlet 3*b* of the air nozzle 3, and an L-shaped suction tube 25 for receiving the end from the yarn catcher 26 and disposing it along a predetermined passage between the top and bottom side elements of the drafting means, as stated later.

Figure 5:
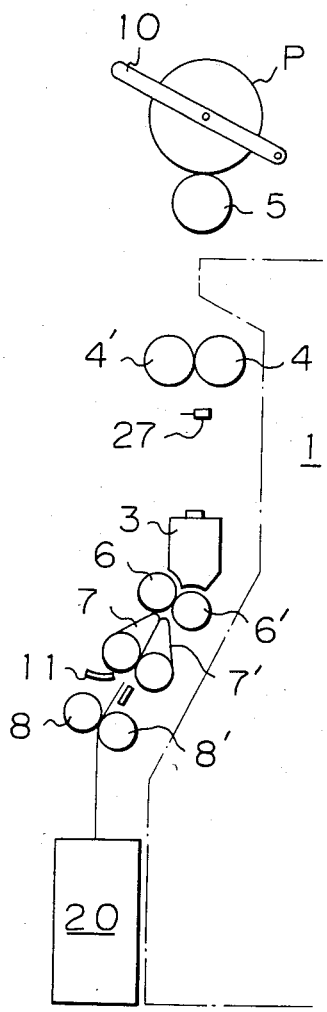
FIG. 5 is a schematic side view of a fasciated yarn spinning unit just before a yarn piecing operation is commenced.

The operations of the piecer are as follows: when the yarn detector 27 detects yarn breakage, it emits a yarn breakage signal to the magnetic clutch $MC_3$, corresponding to the back bottom roller 8', which then stops the rotation of the back rollers 8, 8'. The middle pair 7, 7' and the front pair 6, 6' continue to rotate as usual. Thereby, the fiber bundle is forcibly broken between the back pair 8, 8' and the middle 7, 7' and the front portion thereof is discharged out from the drafting means through the front pair 6, 6'. The fiber bundle stops being fed and its leading end is kept between the back pair 8, 8' and the middle pair 7, 7', as shown in FIG. 5.

The yarn detector 27 also transmits a signal to the yarn piecer, which thereupon comes in front of the spinning unit in problem to commence the piecing operation. First, the air cylinders corresponding to the front top roller 6 and the middle top apron 7 are operated to release them from the corresponding bottom side elements 6' and 7'. As a result, the top side elements 6, 7 are maintained above the bottom side elements 6', 7' with the gap H therebetween. In this case, the bottom side elements 6' 7' continue to rotate.

Figure 6:
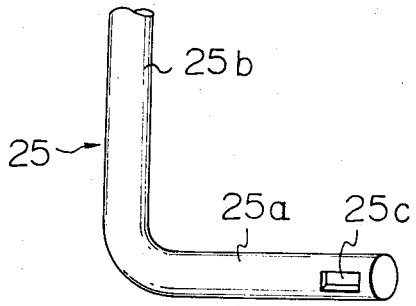
FIG. 6 is a perspective view of part of a suction tube.
Figure 7:
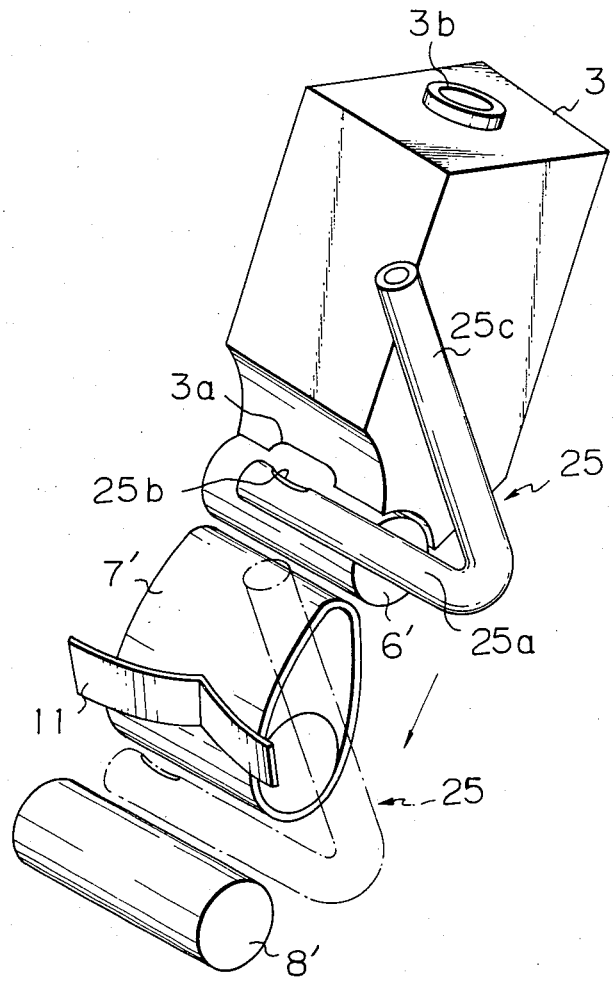
FIG. 7 is a perspective view showing the motion of the suction tube relative to the drafting means.

As shown in FIG. 6, the suction tube 25 comprises a lateral portion 25*a* and a vertical portion 25*b*. The lateral portion 25*a* has a suction opening 25*c* on the side wall near the tip end thereof. The vertical portion 25*b* is connected to a suction source (not shown). In the non-operative position, the suction tube 25 is disposed above the drafting means 2 with the lateral portion 25*a* parallel to the axis of each element of the drafting means 2 and with the vertical portion 25*b* at one side of the drafting means. After the top side elements 6, 7 are released, the suction tube 25 moves downward to insert the lateral portion 25*a* into the gap between the top side elements 6, 7 and the bottom side elements 6', 7' so that the suction opening 25*c* confronts the inlet opening 3*a* of the air nozzle 3. FIG. 7 illustrates this state, in which the top side elements are omitted so as to clearly show the suction tube 25.

Next, the rewinding roller 24 is operated to slowly rotate the yarn package P reversely. At the same time, the yarn catcher 26 searches and picks up for the trailing end of the broken yarn on the package surface, as depicted by chain lines in FIG. 8. Then, the yarn catcher 26 moves toward the outlet 3*b* in synchronization with the rewinding operation of the rewinding roller 24, while holding the trailing end thereon.

Prior to arrival of the trailing end, the suction tube 25 starts the sucking operation. A suction stream is generated from the outlet 3*b* of the air nozzle 3 to the suction tube 25 through the channel 30 of the air nozzle 3. Accordingly, when the trailing end of the yarn is released from the yarn catcher 26, it is sucked into the channel 30 and then is sucked into the suction tube 25.

Figure 9:
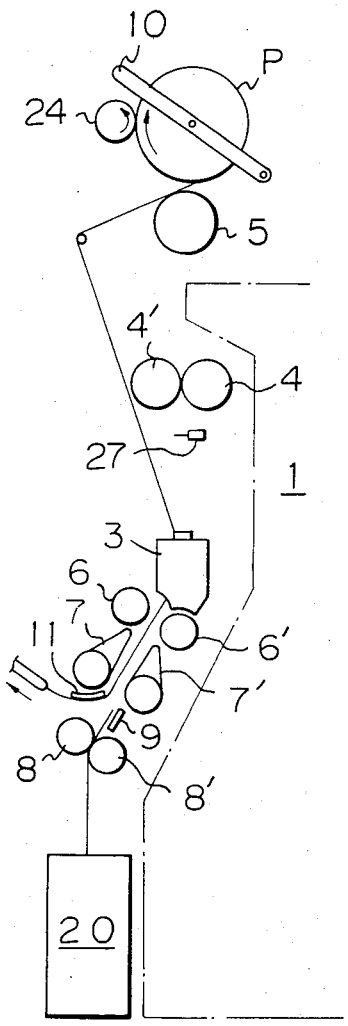
Figure 10:
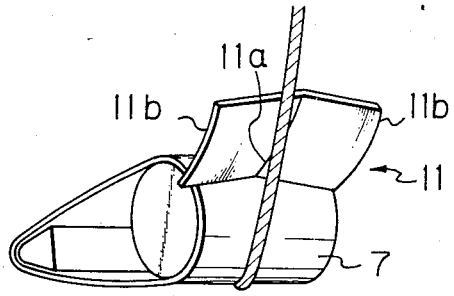
FIG. 10 is a perspective view of a guide plate.

Then, the suction nozzle 25 moves backward along the drafting means 2. The lateral portion 25*a* passes through the gap H between the top side elements 6, 7 and the bottom side elements 6', 7' and then separates from the drafting means 2 through a space behind the middle pair 7, 7'. The rewinding operation of the rewinding roller 24 ceases at this moment. The yarn held by the suction tube 25 lies on a predetermined yarn passage between the top and bottom elements of the front rollers 6, 6' and the middle aprons 7, 7' and extends outside of the drafting means 2 through the space between the back top roller 8 and the middle top apron 7, as shown in FIG. 9. A guide plate 11 fixedly disposed behind the middle top apron 7 facilitates positioning of the yarn in line with the center axis of the drafting means 2 due to its structure, as shown in FIG. 10, which comprises left and right wings 11*b* slanted to constitute a concave center portion 11*a*. The yarn is naturally guided to the center portion 11*a* due to its own tension and lies on the predetermined yarn passage.

Thereafter, the magnetic clutch MC3 for the back bottom roller 8' is operated to rotate the back pair 8, 8', whereupon the fiber bundle begins to run forward again. Then, the air cylinder 41*b* for the middle top apron 7 is operated to press it onto the middle bottom apron 7' after a predetermined time delay T described hereunder. Thus, the yarn is nipped by the middle aprons 7,7'. At the same time, a cutter 28 provided in the vicinity of the suction opening 25*c* is operated to severe the yarn to provide a trailing end having a predetermined length L.

Figure 11:
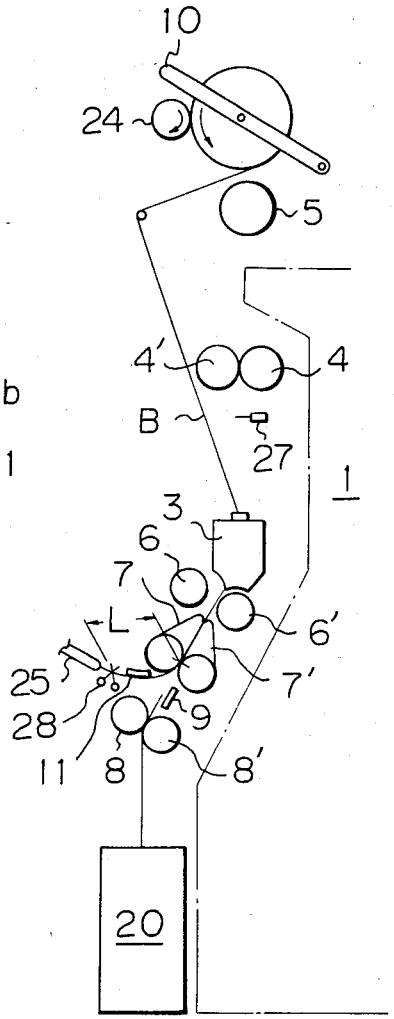

On the other hand, the rewinding roller 24 starts to drive the yarn package P with a speed corresponding to that of the middle pair, and the compressed air is supplied in the air nozzle 3 to generate the vortex. Thus the yarn extending from the package P runs forward while being nipped by the top and bottom aprons 7, 7′ in such a manner that the trailing end of the yarn is overlapped with the leading end of the fiber bundle along a predetermined length stated later. In the air nozzle 3, the ends are entangled with each other by the vortex (FIG. 11).

Next, the air cylinder associated with the front top roller 6 is operated to press the front top roller 6 onto the front bottom roller 6′. Simultaneously, the yarn package P is released from the rewinding roller 24 and is disposed on the surface of the take-up roller 5.

Thus, the yarn piecing operation is completed, and normal yarn spinning is started again.

In the present invention, the timings for starting and stopping the associated parts of the spinning unit and the yarn piecer are very important. In particular, the relation of the length L of the yarn to be reserved to the delay time T should be decided taking the processing speed into account, so that the proper overlapping length of the yarn with the fiber bundle is obtained. According to the present inventors' experience, the overlapping length is preferably in a range from 10 to 30 mm to ensure a good strength as well as good appearance of the resultant yarn.

As stated above, according to the present invention, since the ends of the yarn and the fiber bundle to be pieced move together under soft pressure of the middle aprons, they tend to partially intermingle with each other during the passage and therefore can be completely united by the vortex applied thereafter.

We claim:

1. A method for yarn piecing in a fasciated yarn spinning unit, said unit comprising a drafting means having a front pair of top and bottom rollers, a middle pair of top and bottom aprons, and a back pair of top and bottom rollers; an air nozzle; and a yarn detector; whereby a fiber bundle attenuated by said drafting means is false-twisted to be a yarn by a vortex generated in said air nozzle and is wound to form a package under watching for yarn breakage by said yarn detector, said method comprising the steps of:

breaking the fiber bundle between the back pair of top and bottom rollers and the middle pair of top and bottom aprons by stopping rotation of said back bottom roller in accordance with a yarn breakage signal from said yarn detector while allowing the middle aprons and front rollers to continue to rotate;

introducing said yarn unwound from said package reversely into said air nozzle from an outlet at the package side thereof to a yarn inlet at the drafting means side thereof;

separating the top apron from the bottom apron to form a gap therebetween;

guiding the yarn, unwound from the package, from the inlet of the air nozzle through the gap;

nipping said yarn between said middle top and bottom apron pair;

restarting generation of said vortex; and restarting said back pair with such a time delay after the preceeding nipping step that a leading end of said fiber bundle can overlap with a trailing end of said yarn within a nipping zone of said middle apron pair.

2. A method according to claim 1, in which, prior to said nipping step of said middle apron pair, said top roller of said front roller pair is separated from said bottom roller to form a gap therebetween and guiding said yarn through said gap and the gap between the apron pair.

3. A method according to claim 2, in which, prior to said nipping step of said middle apron pair, said yarn guided through said gap is cut to have a predetermined trailing length.

4. A method according to claim 1, in which, prior to said nipping step of said middle apron pair, said yarn guided through said gap is cut to have a predetermined trailing length.

* * * * *